US005715131A

United States Patent [19]

Matsuyama et al.

[11] Patent Number: 5,715,131

[45] Date of Patent: Feb. 3, 1998

[54] CHARGING DEVICE THAT CAN CHARGE A BODY UNIFORMLY

[75] Inventors: Kazuhiro Matsuyama; Takashi Sakai; Haruo Nishiyama, all of Nara, Japan

[73] Assignee: Sharp Kabushiki Kaisha, Osaka, Japan

[21] Appl. No.: 543,382

[22] Filed: Oct. 16, 1995

[30] Foreign Application Priority Data

Oct. 19, 1994 [JP] Japan ..... 6-253651

[51] Int. Cl.[6] ..... G03G 15/02

[52] U.S. Cl. ..... 361/225; 399/170

[58] Field of Search ..... 361/225, 229, 361/230, 231; 250/235, 324–326; 399/168, 170–173

[56] References Cited

U.S. PATENT DOCUMENTS

| | | | |
|---|---|---|---|
| 3,460,156 | 8/1969 | Byrd | 250/324 |
| 3,691,373 | 9/1972 | Compton et al. . | |
| 3,900,735 | 8/1975 | Jahn | 250/324 |
| 3,916,269 | 10/1975 | Lanker | 361/229 |
| 3,959,690 | 5/1976 | Leibrecht | 361/230 |
| 5,300,986 | 4/1994 | Mishra et al. | 399/171 |
| 5,412,213 | 5/1995 | Kido et al. | 250/326 |
| 5,466,938 | 11/1995 | Nakayama et al. | 250/326 |
| 5,521,383 | 5/1996 | Furukawa et al. | 250/324 |

FOREIGN PATENT DOCUMENTS

| | | |
|---|---|---|
| 5-2314 | 1/1993 | Japan . |
| 6-11947 | 1/1994 | Japan . |

*Primary Examiner*—Fritz Fleming

[57] ABSTRACT

The relationship between a discharge gap and a surface potential, and a relationship between a discharge gap and a surface potential variation are obtained. Then, a range of a discharge gap is obtained (approximately 5~10 mm) satisfying a range of the required surface potential (–600 V) and the tolerable surface potential variation (30 V). The relationship of the discharge gap with respect to the surface potential and the surface potential variation is varied by reducing the applied current. The discharge gap is converged to one value (approximately 7.5 mm) in response to the range of the discharge gap being reduced.

20 Claims, 17 Drawing Sheets

| No. | DISTANCE FROM STANDARD DIMENSION | No. | DISTANCE FROM STANDARD DIMENSION | No. | DISTANCE FROM STANDARD DIMENSION | No. | DISTANCE FROM STANDARD DIMENSION |
|---|---|---|---|---|---|---|---|
| 1 | -0.140 | 29 | -0.194 | 57 | -0.226 | 85 | -0.226 |
| 2 | -0.140 | 30 | -0.214 | 58 | -0.232 | 86 | -0.196 |
| 3 | -0.140 | 31 | -0.224 | 59 | -0.242 | 87 | -0.200 |
| 4 | -0.140 | 32 | -0.214 | 60 | -0.224 | 88 | -0.196 |
| 5 | -0.140 | 33 | -0.214 | 61 | -0.236 | 89 | -0.208 |
| 6 | -0.150 | 34 | -0.222 | 62 | -0.224 | 90 | -0.194 |
| 7 | -0.154 | 35 | -0.204 | 63 | -0.236 | 91 | -0.198 |
| 8 | -0.154 | 36 | -0.220 | 64 | -0.224 | 92 | -0.196 |
| 9 | -0.154 | 37 | -0.220 | 65 | -0.224 | 93 | -0.176 |
| 10 | -0.140 | 38 | -0.228 | 66 | -0.220 | 94 | -0.178 |
| 11 | -0.164 | 39 | -0.220 | 67 | -0.226 | 95 | -0.186 |
| 12 | -0.176 | 40 | -0.228 | 68 | -0.216 | 96 | -0.186 |
| 13 | -0.176 | 41 | -0.236 | 69 | -0.206 | 97 | -0.176 |
| 14 | -0.184 | 42 | -0.240 | 70 | -0.200 | 98 | -0.180 |
| 15 | -0.176 | 43 | -0.236 | 71 | -0.210 | 99 | -0.160 |
| 16 | -0.184 | 44 | -0.240 | 72 | -0.204 | 100 | -0.176 |
| 17 | -0.180 | 45 | -0.224 | 73 | -0.220 | 101 | -0.170 |
| 18 | -0.188 | 46 | -0.230 | 74 | -0.208 | 102 | -0.180 |
| 19 | -0.186 | 47 | -0.236 | 75 | -0.212 | 103 | -0.176 |
| 20 | -0.192 | 48 | -0.226 | 76 | -0.222 | 104 | -0.188 |
| 21 | -0.202 | 49 | -0.220 | 77 | -0.216 | 105 | -0.196 |
| 22 | -0.208 | 50 | -0.236 | 78 | -0.220 | 106 | -0.200 |
| 23 | -0.200 | 51 | -0.232 | 79 | -0.220 | 107 | -0.196 |
| 24 | -0.184 | 52 | -0.224 | 80 | -0.204 | | min=-0.140 |
| 25 | -0.200 | 53 | -0.230 | 81 | -0.196 | | max=-0.242 |
| 26 | -0.200 | 54 | -0.214 | 82 | -0.198 | | |
| 27 | -0.220 | 55 | -0.242 | 83 | -0.118 | | UNIT(mm) |
| 28 | -0.204 | 56 | -0.232 | 84 | -0.190 | | |

| No. | DISTANCE FROM STANDARD DIMENSION | No. | DISTANCE FROM STANDARD DIMENSION | No. | DISTANCE FROM STANDARD DIMENSION | No. | DISTANCE FROM STANDARD DIMENSION |
|---|---|---|---|---|---|---|---|
| 1 | +0.082 | 29 | -0.036 | 57 | +0.022 | 85 | -0.008 |
| 2 | -0.090 | 30 | +0.022 | 58 | -0.034 | 86 | +0.016 |
| 3 | +0.054 | 31 | -0.020 | 59 | +0.006 | 87 | -0.024 |
| 4 | -0.028 | 32 | +0.018 | 60 | -0.100 | 88 | +0.020 |
| 5 | -0.070 | 33 | -0.020 | 61 | +0.110 | 89 | +0.018 |
| 6 | +0.108 | 34 | +0.042 | 62 | -0.040 | 90 | -0.022 |
| 7 | -0.030 | 35 | -0.044 | 63 | +0.022 | 91 | +0.042 |
| 8 | +0.028 | 36 | +0.020 | 64 | +0.088 | 92 | -0.012 |
| 9 | -0.024 | 37 | +0.040 | 65 | -0.100 | 93 | -0.022 |
| 10 | +0.040 | 38 | -0.048 | 66 | +0.028 | 94 | +0.120 |
| 11 | -0.018 | 39 | -0.022 | 67 | -0.040 | 95 | -0.148 |
| 12 | -0.022 | 40 | +0.086 | 68 | +0.020 | 96 | +0.022 |
| 13 | +0.042 | 41 | -0.098 | 69 | -0.034 | 97 | -0.044 |
| 14 | -0.028 | 42 | +0.022 | 70 | -0.010 | 98 | +0.084 |
| 15 | +0.020 | 43 | -0.028 | 71 | +0.022 | 99 | -0.022 |
| 16 | +0.012 | 44 | +0.032 | 72 | -0.044 | 100 | +0.112 |
| 17 | -0.042 | 45 | -0.022 | 73 | +0.028 | 101 | -0.128 |
| 18 | +0.080 | 46 | +0.016 | 74 | -0.110 | 102 | +0.044 |
| 19 | -0.062 | 47 | -0.006 | 75 | +0.088 | 103 | -0.050 |
| 20 | +0.024 | 48 | +0.028 | 76 | -0.022 | 104 | +0.018 |
| 21 | -0.042 | 49 | -0.010 | 77 | +0.040 | 105 | -0.028 |
| 22 | +0.002 | 50 | +0.042 | 78 | -0.018 | 106 | +0.162 |
| 23 | +0.034 | 51 | -0.020 | 79 | +0.024 | 107 | -0.150 |
| 24 | -0.028 | 52 | -0.016 | 80 | -0.056 | | min=-0.148 |
| 25 | +0.032 | 53 | +0.034 | 81 | +0.040 | | max=+0.162 |
| 26 | +0.010 | 54 | -0.018 | 82 | +0.020 | | |
| 27 | -0.026 | 55 | +0.008 | 83 | -0.044 | | UNIT(mm) |
| 28 | +0.044 | 56 | -0.010 | 84 | +0.008 | | |

FIG. 12

| DISCHARGING TIME / NUMBER OF COPIES | 0h | 10h | 20h | 30h |
|---|---|---|---|---|
| | 0 | 1000 | 20000 | 30000 |
| RESISTANCE VALUE | APPROXIMATELY 500MΩ | APPROXIMATELY 1000MΩ | APPROXIMATELY 1500MΩ | APPROXIMATELY 2000MΩ |
| RESISTANCE VALUE VARIATION | APPROXIMATELY ±30% | APPROXIMATELY ±32% | APPROXIMATELY ±35% | APPROXIMATELY ±40% |

FIG. 14

| TEMPERATURE | 0°C | 10°C | 20°C | 30°C | 40°C | 50°C |
|---|---|---|---|---|---|---|
| RESISTANCE VALUE | APPROXIMATELY 400MΩ | APPROXIMATELY 450MΩ | APPROXIMATELY 500MΩ | APPROXIMATELY 550MΩ | APPROXIMATELY 600MΩ | APPROXIMATELY 650MΩ |
| RESISTANCE VALUE VARIATION | APPROXIMATELY ±27% | APPROXIMATELY ±29% | APPROXIMATELY ±30% | APPROXIMATELY ±31% | APPROXIMATELY ±33% | APPROXIMATELY ±36% |

FIG. 16

| HUMIDITY | 20% | 30% | 40% | 50% | 60% | 70% | 80% |
|---|---|---|---|---|---|---|---|
| RESISTANCE VALUE | APPROXIMATELY 400MΩ | APPROXIMATELY 430MΩ | APPROXIMATELY 465MΩ | APPROXIMATELY 500MΩ | APPROXIMATELY 535MΩ | APPROXIMATELY 570MΩ | APPROXIMATELY 600MΩ |
| RESISTANCE VALUE VARIATION | APPROXIMATELY ±27% | APPROXIMATELY ±28% | APPROXIMATELY ±29% | APPROXIMATELY ±30% | APPROXIMATELY ±31% | APPROXIMATELY ±32% | APPROXIMATELY ±33% |

CHARGING DEVICE THAT CAN CHARGE A BODY UNIFORMLY

BACKGROUND OF THE INVENTION

1. Field of the Invention

The present invention relates to a corona discharge type charging device that can charge uniformly a body to be charged such as a photoreceptor by usage of corona discharge in an electrophotography device such as a copier or a printer.

2. Description of the Background Art

A corona discharge type charging device using a plurality of needle-like or sawtooth-like discharging electrodes is known as a charging device employed in an electrophotography device such as a copier or a printer. This type of charging device is significantly advantageous in its structural and operational manner in comparison with those of a wire type. The corona discharge type charging device has a relatively high structural strength and low driving voltage.

However, the discharge between each discharging electrode is not uniform due to various factors such as critical difference in the configuration of the tip of each needle-like or sawtooth-like discharging electrode, damage, and contamination thereof. An extremely high applied current must be conducted to obtain uniform charging. Although this applied current is approximately ⅕ that of a wire type charging device, there is still a noticeable problem that the amount of generated ozone is great. In the following description, the reference of run-off current and discharge current is equal to applied current.

Japanese Patent Laying-Open No. 5-2314 discloses a solution of the above-described problems. Each discharging electrode is connected to a power supply via individual resistors to have the current flowing across the discharging electrode controlled and stabilized.

An example of such type of charging device is shown in FIGS. 19A and 19B. A common electrode 2 is formed on an insulative substrate 1. A plurality of discharging electrodes 3 are disposed at the distance of pitch P (approximately 2 mm) with a constant distance from common electrode 2. Common electrode 2 is connected to a high voltage power supply +Vcc. A resistor 5 (resistance:Rc) is inserted between common electrode 2 and each discharging electrode 3. Resistor 5 serves to lower the applied voltage by a constant voltage to stabilize the discharging current flowing across each discharging electrode 3. Thus, the applied current can be reduced. Resistor 5 is formed of a polymer organic material including a chip resistance or carbon and the like.

FIG. 20 shows the main components of an electrophotography device including the above-described charging device. A photoreceptor 12 is a drum base formed of a conductive material such as aluminum, having the shaft supported in a rotatable manner. Photoreceptor 12 has a photo-conductor layer of an OPC (organic photosensitive material) formed at the surface of the base. Photoreceptor 12 is rotated in the direction of the arrow in FIG. 20. A charging device 10 for charging uniformly the surface of photoreceptor 12, a developer device 14 for attaching toner onto the surface of photoreceptor 12, a charging device (transfer device) 11 for transferring the toner on photoreceptor 12 onto a sheet of paper 8, a cleaner 16 for removing the remaining toner from the surface of photoreceptor 12, and a discharging device 17 for discharging the surface of photoreceptor 12 are all arranged in this order around photoreceptor 12. Photoreceptor 12 is exposed by light (reflected light from original, laser beam, light from LED, etc.) between charging device 10 and developer device 14 directed from an optical device not shown, whereby an electrostatic latent image is formed. The charging device shown in FIG. 19 is applied as charging devices 10 and 11. 10*a* and 11*a* refer to shield cases. A grid device 15 including a grid electrode 15*a* may be provided as shown in the broken line in charging device 10. Voltage for charging uniformly the surface of photoreceptor 12 is applied to grid electrode 15*a*.

The above-described conventional charging device is disadvantageous as set forth in the following.

In setting the discharge gap (the distance between photoreceptor and discharging electrode) to an appropriate value in the above-described charging device, the following problems were encountered.

(1) If the discharge gap is too great, the applied current to obtain a surface potential greater than a predetermined value Vo must be increased, which leads to increase in the generated amount of ozone and power consumption. If the discharge gap is too small, deviation in the surface potential becomes significant. This requires increase in the applied current to suppress this deviation.

(2) In a charging device having a resistor 5 inserted between each discharging electrode 3 and common electrode 2 as shown in FIGS. 19A and 19B (this type is referred to as "individual electrode type" hereinafter, and is distinguished from the "integral electrode type" which includes an integral electrode with no insertion of resistor 5), applied current can be reduced by virtue of the provision of resistor 5. However, since the applied current is low, the current flowing from each discharging electrode to the photoreceptor is not constant due to variation in the resistance of resistor 5 and the precision of attaching each individual electrode. As a result, there is difference in the surface potential at the surface of the photoreceptor. To prevent this variation, the discharge gap must be increased.

(3) Each discharging electrode exhibits critical difference in its charging performance due to variation in the configuration and dimension of the tip portion of each discharging electrode, and influence of the density distribution of moisture (humidity) in the air, in addition to the above-described (2).

An appropriate value must be selected for the discharge gap to carry out uniform charging in view of the foregoing problems. Conventionally, the discharge gap was determined by carrying out a plurality of charging experiments while altering appropriately the discharge gap during the design stage. This trial experiment is repeated until sufficient surface potential characteristics and surface potential variation characteristics were obtained. There was a problem that the step of determining the discharge gap was time consuming.

SUMMARY OF THE INVENTION

An object of the present invention is to provide a charging device and a method of designing the same that can have the time required for determining the discharge gap reduced by limiting the predetermined range of the discharge gap and the reference for determining the discharge gap in the designing stage thereof.

According to a charging device of an aspect of the present invention, a discharge gap La satisfies the relationship of $L2 \leqq La \leqq L1$ where L1 is the upper limit value of the discharge gap in which a surface potential greater than a predetermined surface potential Vo is obtained, and L2 is the lower limit value of the discharge gap in which a surface potential variation not more than a predetermined tolerable surface potential variation ΔVp is obtained.

Thus, a range of a discharge gap La can be limited to a region where the required surface potential Vo is obtained and the surface potential variation is within a tolerable range of ΔVp. By limiting the range of discharge gap La, the number of steps of the design process of the charging device can be reduced to shorten the processing time period.

According to a charging device of another aspect of the present invention, an applied current is set so that the upper limit value of the discharge gap where a surface potential greater than a predetermined surface potential Vo is obtained is substantially equal to the lower limit value of the discharge gap where a surface potential variation less than a predetermined tolerable surface potential variation ΔVp is obtained. Furthermore, discharge gap La is set so that the above-described upper limit value is substantially equal to the lower limit value.

Thus, discharge gap La can be limited to a certain value in which the required surface potential Vo can be obtained and where the surface potential variation is within the variable range of ΔVp. Therefore, the discharge gap can be gradually limited on the basis of the reference, and not by a random manner where the discharge gap is appropriately varied. Thus, the process of determining the discharge gap is simplified, and the time required for processing can be shortened.

According to a further aspect of the present invention, a discharge gap La of a charging device satisfies the relationship of $L3 \leqq La \leqq L1$ where L1 is the upper limit value of the discharge gap in which a surface potential greater than a predetermined surface potential Vo is obtained, and L3 is the discharge gap value in which a surface potential variation less than a predetermined tolerable surface potential variation ΔVp is obtained, and when the applied current with a resistor is substantially equal to that with no resistor.

As a result, the range of discharge gap La can be limited where the required surface potential Vo can be obtained, and the applied current becomes smaller than the tolerable value of Ipp. Thus, the number of steps in the design process of the charging device can be reduced to shorten the processing time period thereof.

According to a charging device of still another aspect of the present invention, the resistance of a resistor is set to a minimum resistance value Rcmin that can provide the minimum voltage drop required for absorbing the surface potential variation, and discharge gap La satisfies the relationship of $L6 \leqq La \leqq L5$ where L5 is the upper limit value of the discharge gap in which a surface potential greater than a predetermined surface potential Vo is obtained, and L6 is the lower limit value of the discharge gap in which a surface potential variation smaller than a predetermined tolerable surface potential variation ΔVp is obtained.

As a result, a range L6–L5 of a discharge gap can be found where the required surface potential Vo and a surface potential variation less than a tolerable surface potential variation ΔVp can be obtained. In this case, resistance value Rc of the resistor inserted between a discharging electrode and a high voltage power supply is set to a minimum value where the required voltage drop can be obtained. The applied current can also be set to a low value of the minimum level. Therefore, the problem of increase in the generated amount of ozone or power consumption is not encountered.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 12 is a graph showing variation in resistance over time.

FIG. 14 is a diagram for showing a change in the resistance variation due to temperature.

FIG. 16 shows a change in the resistance value variation due to humidity.

DESCRIPTION OF THE PREFERRED EMBODIMENTS

Figure 19A:
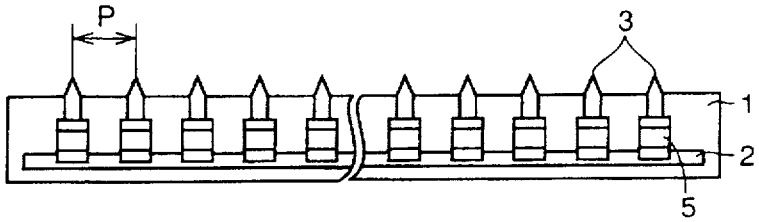
FIG.19A PRIOR ART
FIG. 19A shows a general structure of the discharging electrode portion and the resistor portion of a conventional charging device.
Figure 19B:
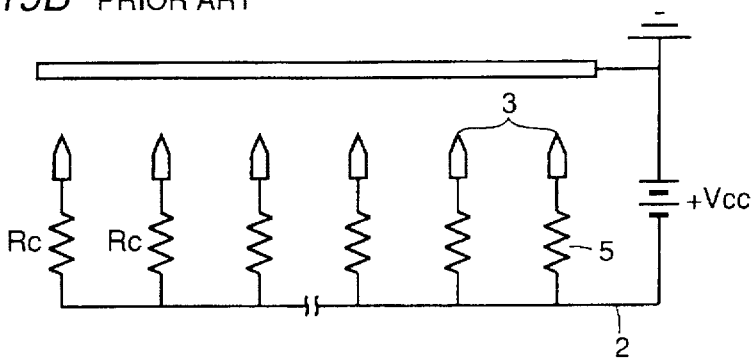
FIG.19B PRIOR ART
FIG. 19B shows an electrical structure of the discharge electrode portion and the resistor portion shown in FIG. 19A.
Figure 20:
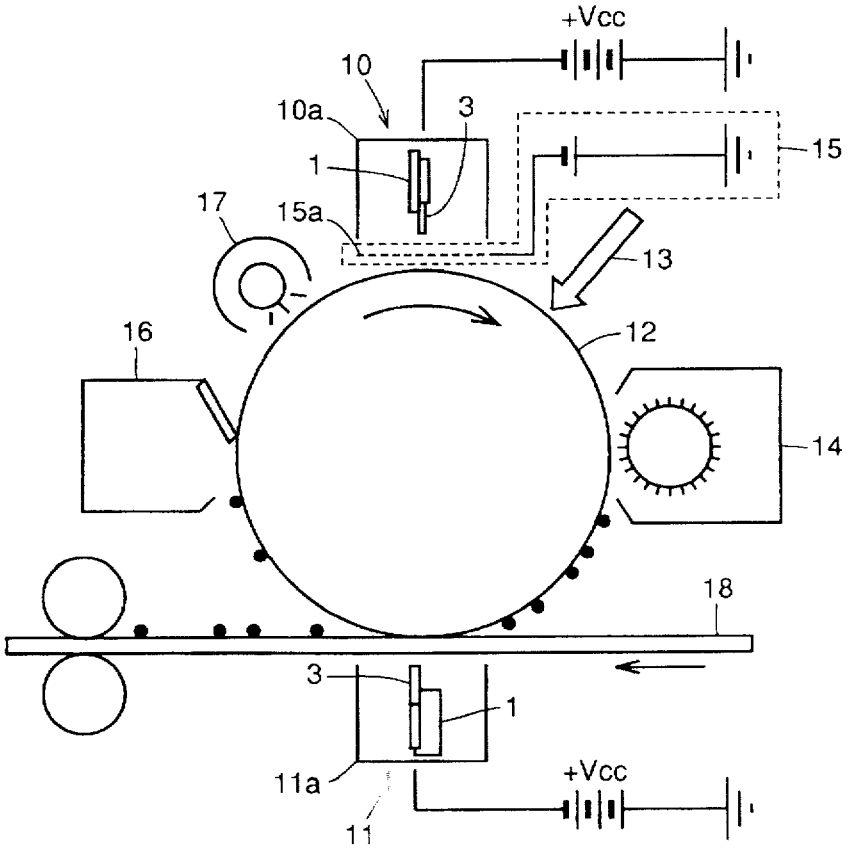
FIG.20 PRIOR ART
FIG. 20 shows the main components of an electrophotography device including the charging device of FIG. 19.

A charging device according to an embodiment of the present invention has a structure similar to that shown in FIGS. 19 and 20. Therefore, the charging device of the present invention will be described according to FIGS. 19 and 20, provided that discharge gap La refers to the distance between photoreceptor 12 and the tip of discharging electrode 3 in the case of a charging device without a grip device 15, and the distance between grid electrode 15*a* and the tip of discharging electrode 3 in the case of a charging device with grid device 15.

Figure 4A:
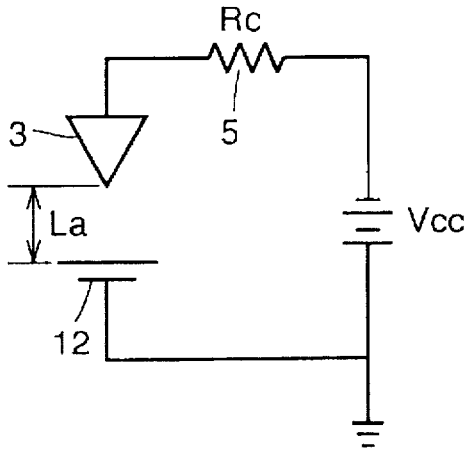
FIG. 4A schematically shows a charging device.
Figure 4B:
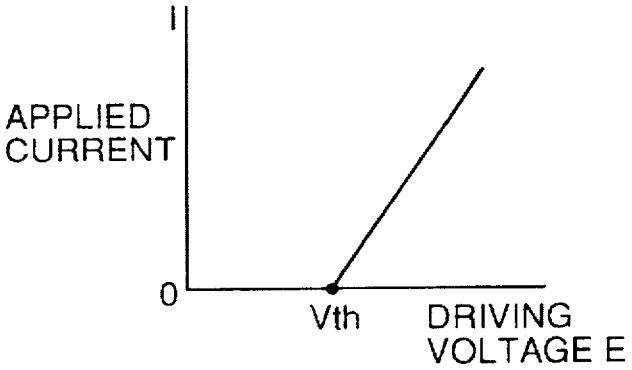
FIG. 4B shows the discharge characteristics of the charging device.
Figure 4C:
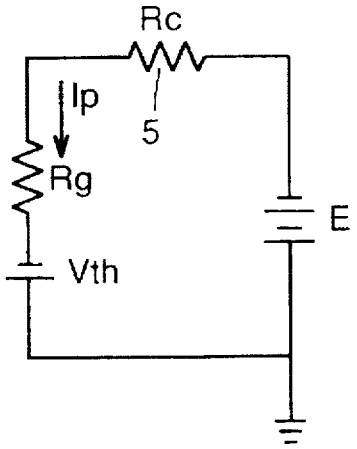
FIG. 4C is an equivalent circuit diagram of the charging device.

Referring to FIGS. 4A–4C, the charging device of the present invention has the current controlled to establish a constant current. The applied current is stabilized on the basis of the voltage drop across resistor 5 (resistance value:Rc). Applied current Ip of the circuit can be obtained by the following equation.

$$Ip=(E-Vth)/(Rg+Rc)$$

Ip: applied current. The value of current flowing to one point of a plurality of discharging electrodes. Set to approximately (–) 1~1.5 μA in a charging device including resistor 5.

E: applied voltage by a high voltage power supply. In general, the upper limit is approximately 7000 V.

Rc: resistant value of resistor 5.

Vth: discharge initiated voltage (threshold value). Approximately 3200~3800 V when discharge gap La=7~9 mm.

Rg: gap impedance in discharge gap La. 500~800 MΩ when discharge gap La=7~9 mm.

First Embodiment

Figure 1:
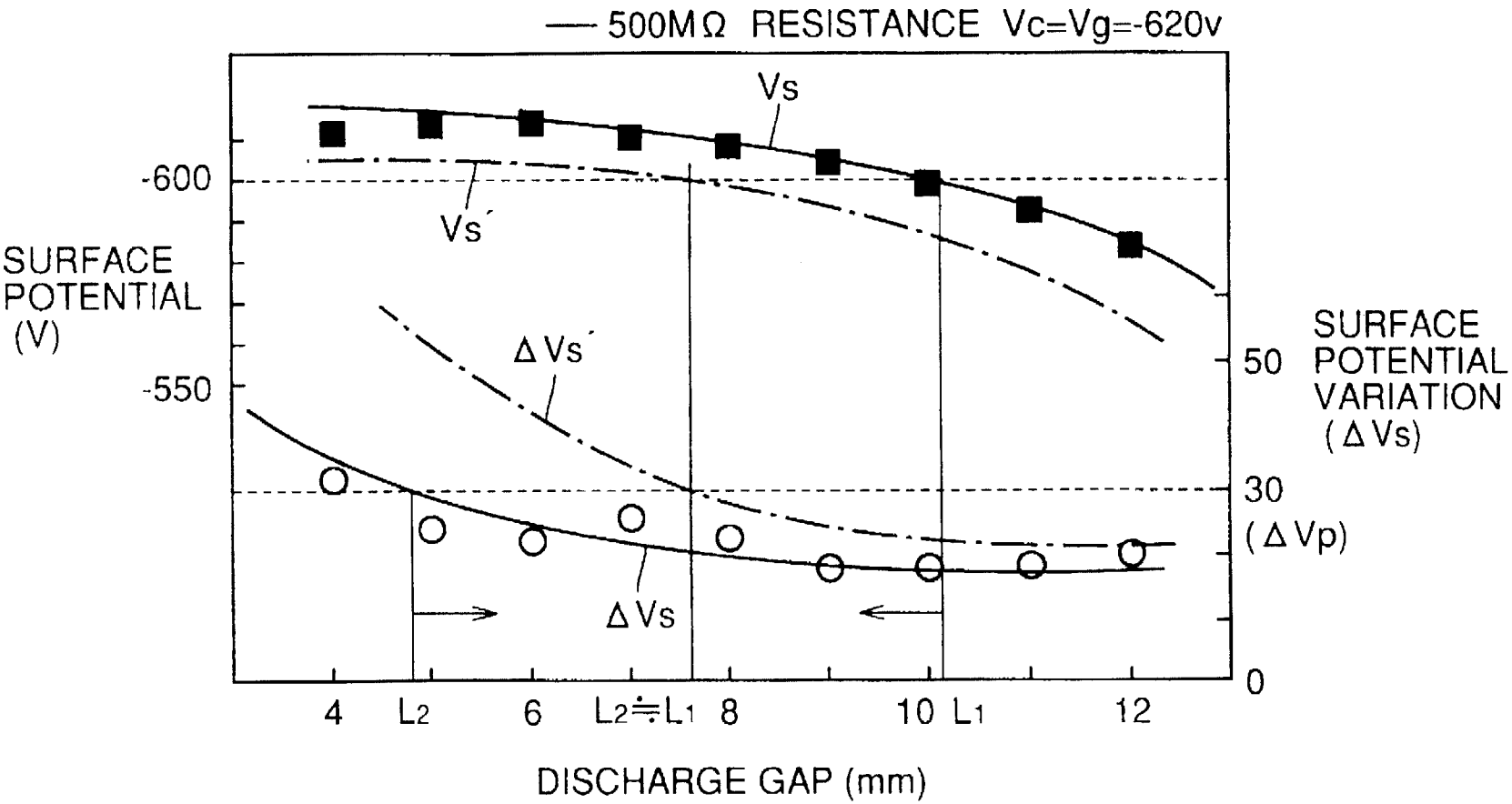
FIG. 1 shows the relationship of a discharge gap, surface potential, and surface potential variation.

As a result of intensive research on the relationship between the discharge gap of a charging device and the charging characteristics of a photoreceptor (body to be charged), the inventors of the present invention found that reduction in discharge gap La causes a rise in the surface potential and increase in the surface potential variation, while increase in discharge gap La causes reduction in the surface potential variation and a lower surface potential, and reduction in the applied current controlled to a constant current by a power supply device causes reduction in the surface potential, and increase in the surface potential variation, whereas increase in applied current causes a higher surface potential and reduction in the surface potential variation. In FIG. 1, the surface potential and the surface potential variation plotted in solid lines and chain dotted lines indicate respective values when the applied current is set to a certain value and to a value lower than the set value, respectively.

In charging the surface of a photoreceptor, the surface potential and the surface potential variation include a threshold value which indicates the limit for forming an image of high quality. For example, in the case of a minus charging photoreceptor, the threshold value of the surface potential is set to at least –800 V approximately (or –600 V), and the threshold value of the surface potential variation comes within approximately 30 V~40 V. Here, it is assumed that the surface potential is set to –600 V and the surface potential variation to 30 V. By observing the crossing point between the surface potential curve and the –600 V line, a surface potential of at least –600 V is obtained where the discharge gap is less than L1 (the upper limit value L1 of the discharge gap where a surface potential of at least the required surface potential Vo is obtained). Observing the crossing point between the surface potential variation curve and the 30 V line, it is appreciated that a surface potential variation of less than 30 V can be obtained at a discharge gap greater than L2 (the lower limit value L2 of the discharge gap where a surface potential variation less than the tolerable surface potential variation ΔVp is seen). As a result, it is appreciated that the required surface potential and surface potential variation can be obtained according to the condition of:

$$L2 \leqq La \leqq L1$$

Thus, the setting range of the discharge gap can be restricted.

As described in the foregoing, FIG. 1 representing the relationship of discharge gap La, surface potential Vs and surface potential variation ΔVs has the surface potential Vo allowing image formation set to –600 V and the tolerable surface potential variation ΔVp set to 30 V. Therefore, discharge gaps L1 and L2 can be obtained by this relationship. Even when Vo and ΔVp are set to different values, respective values of L1 and L2 can easily be obtained since the relationship of La with Vs and ΔVs is determined.

Specific examples of L1 and L2 will be described hereinafter. In an individual electrode type charging device, the applied current is set to approximately –1~2 μA. When the applied current is, for example 2 μA, the range of discharge gap La is set within the range of 5~10 mm as shown by the vertical solid lines in FIG. 1.

Second Embodiment

As shown in the above-described first embodiment, the range of the discharge gap can be limited to a certain level by L1 and L2. In the present second embodiment, a method of identifying one value for discharge gap La will be described. Here, the fact that reduction in applied current causes a lower surface potential and a higher surface potential variation is made use of. More specifically, referring to FIG. 1, when the applied current is lowered with respect to the state shown in the solid line, the surface potential becomes smaller as shown by the chain dotted line in FIG. 1 and the level of the surface potential variation is increased. Therefore, the width of discharge gap L2~L1 becomes smaller. An advance thereof eventually results in discharge gap La converged to one point, i.e., to the value of L1≈L2.

Here, the surface potential and the surface potential variation both represent favorable states. An image of favorable quality can be obtained by setting the values of L1 and L2 as the discharge gap. Furthermore, the generated amount of ozone and power consumption can be suppressed.

By setting the value of L1 and L2 as the discharge gap La when L1≈L2, the applied current can be set to the minimum level, and the amount of generated ozone can be reduced. Also, a stable charging operation can be carried out while suppressing variation in the surface potential. The discharge gap La where L1≈L2 is approximately 7.5 mm. The applied current thereat is approximately 1.5 μA.

Third Embodiment

Figure 2:
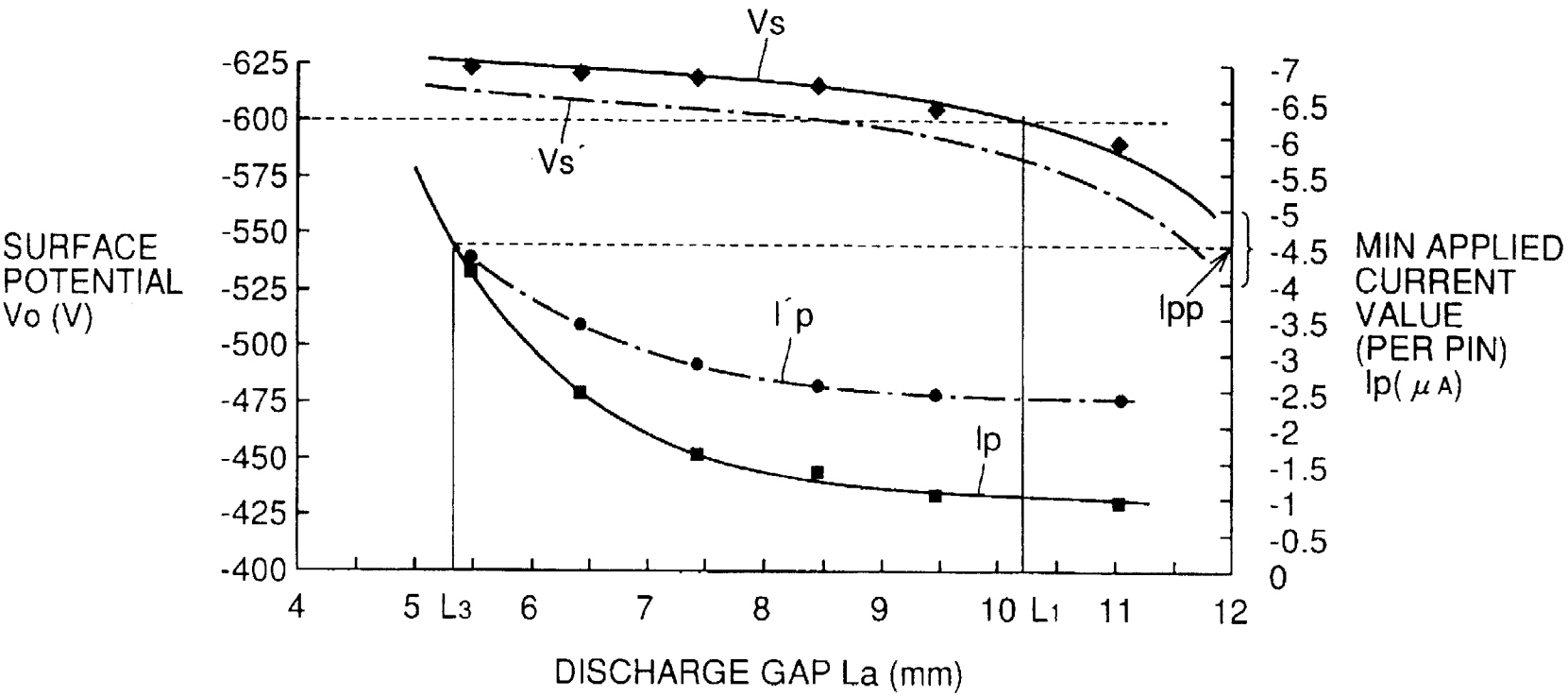
FIG. 2 shows the relationship of a discharge gap, surface potential, and applied current.

Referring to FIG. 2, the relationship between discharge gap La and surface potential Vs is similar to that shown in FIG. 1. The surface potential level becomes lower when the applied current is reduced. The upper limit value L1 can be found of a discharge gap where a surface potential greater than the required surface potential Vo is obtained. Discharge gap L3 where a potential surface variation less than the tolerable surface potential variation ΔVp is obtained and where the applied current is less than the tolerable value of Ipp can be found as set forth in the following.

First, the required minimum applied current (applied current where a surface potential variation less than ΔVp is obtained) is to be found for each discharge gap La. In FIG. 2, Ip is the applied current in the case where a resistor is inserted between a discharging electrode and the power supply device. Here, it is appreciated that the applied current takes a relatively low value. In contrast, the applied value takes a relatively high value as shown by Ip' when a resistor is not inserted between the discharging electrode and the power supply device. This is because variation of the surface potential at the surface of the photoreceptor is reduced due to the insertion of a resistor. There is a possibility that applied current Ip in the case where a resistor is inserted is substantially equal to the applied current Ip' where no resistor is inserted. Equalization of Ip and Ip' implies that the presence of a resistor is meaningless, and the applied current will be increased. Therefore, it is desirable that the discharge current is set to a region lower than threshold value Ipp where Ip substantially equalizes Ip' in a charging device including a resistor. Thus, the threshold value Ipp is set as the tolerable value, and discharge gap L3 is obtained where a current value less than the tolerable value Ipp is obtained on the above-described curve Ip.

On the basis of the obtained discharge gaps L1 and L3, the required discharge gap La is limited to $$L3 \leqq La \leqq L1$$

whereby the setting range of discharge gap La can be restricted.

A specific example is set forth in the following. Applied current Ip required for forming an image of superior quality in the case where resistor 5 is inserted has almost no difference from applied current Ip' required for forming an image of superior quality in the case where resistor 5 is not inserted when an applied current of at least certain level is required. This is approximately −4 μA—5 μA in the case of 500 MΩ, depending upon the resistance of resistor 5. Therefore, −4.5 μA which is an intermediate value thereof can be set as the tolerable current value Ipp. Here, the discharge gap L3 is approximately 5.5 mm.

In contrast, the discharge gap L1 that allows the required surface potential Vo in a general set state is approximately 10 mm as described above. Therefore, the range of discharge gap La is approximately 5.5~10 mm when applied current Ip is limited to a certain value.

The range of approximately 5.5~10 mm for the discharge gap La according to the tolerable value of Vo of the surface potential and tolerable value Ipp of the applied current can further be limited. In this case, applied power Wt is used.

Figure 5:
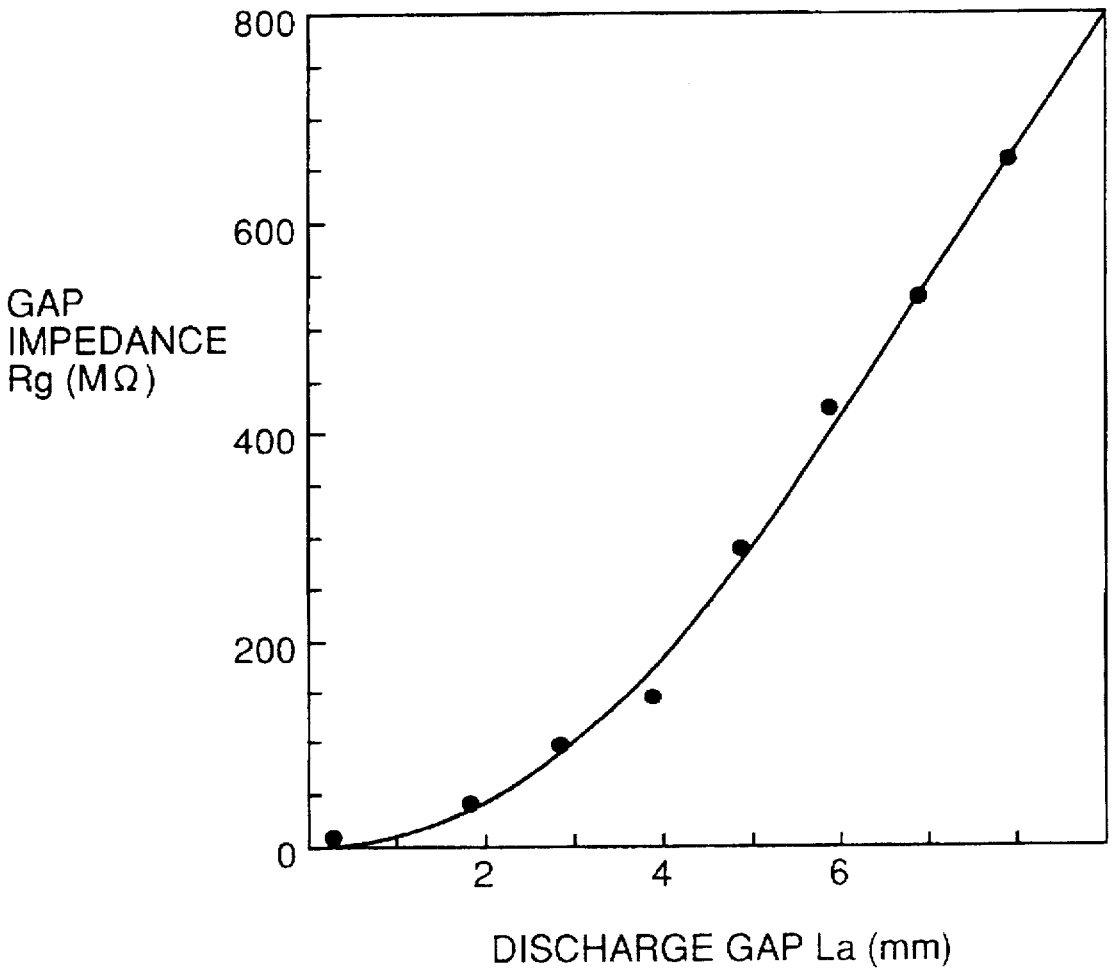
FIG. 5 shows the relationship of a discharge gap and gap impedance.
Figure 6:
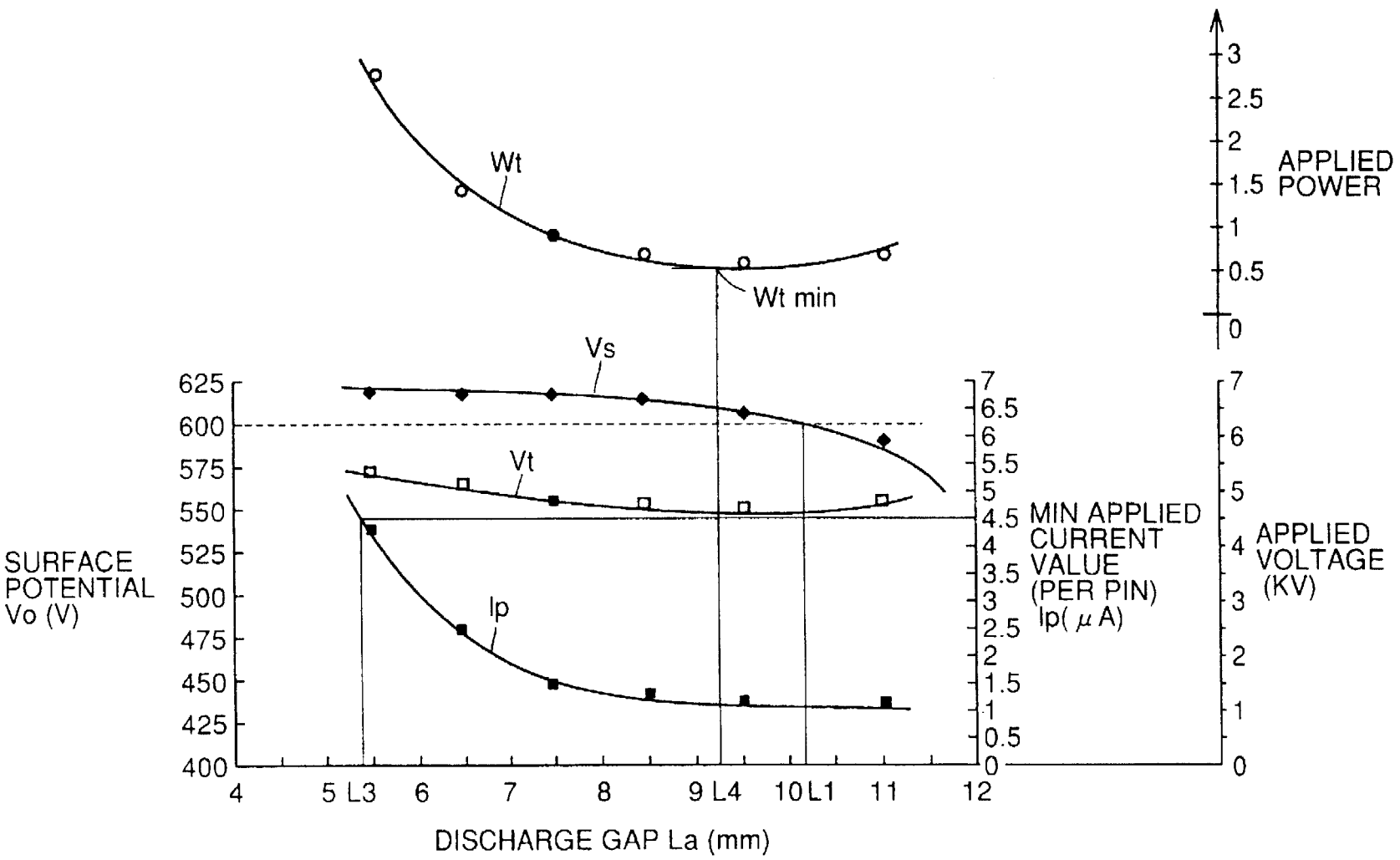
FIG. 6 shows the relationship of a discharge gap, applied current, and applied power.

Applied power Wt corresponds to applied current Ip in a general state. It is increased when the applied current is great, and reduced when the applied current is low. As shown in FIG. 5, the gap impedance Rg becomes higher when discharge gap La is increased. Therefore, there is a point (discharge gap) L4 where applied power Wt is increased even when the applied current Ip is set to a low value as shown in FIG. 6. This discharge gap L4 is where applied power Wt is minimum, and applied current Ip is also extremely low. By setting the discharge gap La=L4, the consumed power of the charging device can be suppressed and applied current Ip be set to a low value, whereby generation of ozone is suppressed. Applied current curve Ip indicates the applied current where an image of favorable quality is obtained. In this case, the condition of $L3 \leqq L4 \leqq L1$ must be satisfied.

By obtaining applied power Wt for supplying an applied current Ip for each discharge gap La required to obtain an image of an allowable quality and setting discharge gap La=L4 when discharge gap L4 satisfies the condition of $L3 \leqq L4 \leqq L1$ at the lowest applied power Wt, the above-described advantages of reducing power consumption of the charging device, suppressing generation of ozone by reducing the value of applied current Ip, and obtaining an image of high quality can be achieved. Discharge gap La=L4 is approximately 9.3 mm.

Fourth Embodiment

The resistor inserted between a discharging electrode and a high voltage power supply serves to stabilize the discharging current of each discharging electrode on the basis of the voltage drop across the resistor. The discharging current of the discharging electrode is stabilized and the surface potential variation of the photoreceptor is reduced as the resistance of the resistor becomes higher. However, increase in the resistance of a resistor necessiates a higher applied power to charge the surface of the photoreceptor, resulting in the problem of increasing the cost. A minimum voltage drop is required in order to stabilize the discharge current. If the resistance of the resistor is too low, the voltage drop will not be sufficient, and surface potential variation for each discharge electrode cannot be absorbed.

In the present embodiment, the resistance of the resistor is set to a lowest possible value (minimum resistance Rcmin) where the required voltage drop can be obtained. Then, the upper limit value L5 of a discharge gap where a surface potential greater than the required surface potential Vo is obtained and the lower limit value L6 of a discharge gap where a surface potential variation less than a tolerable surface potential variation ΔVp is obtained are found under the set low resistance. Then, the range of discharge gap La is set to: $L6 \leqq La \leqq L5$.

Figure 3:
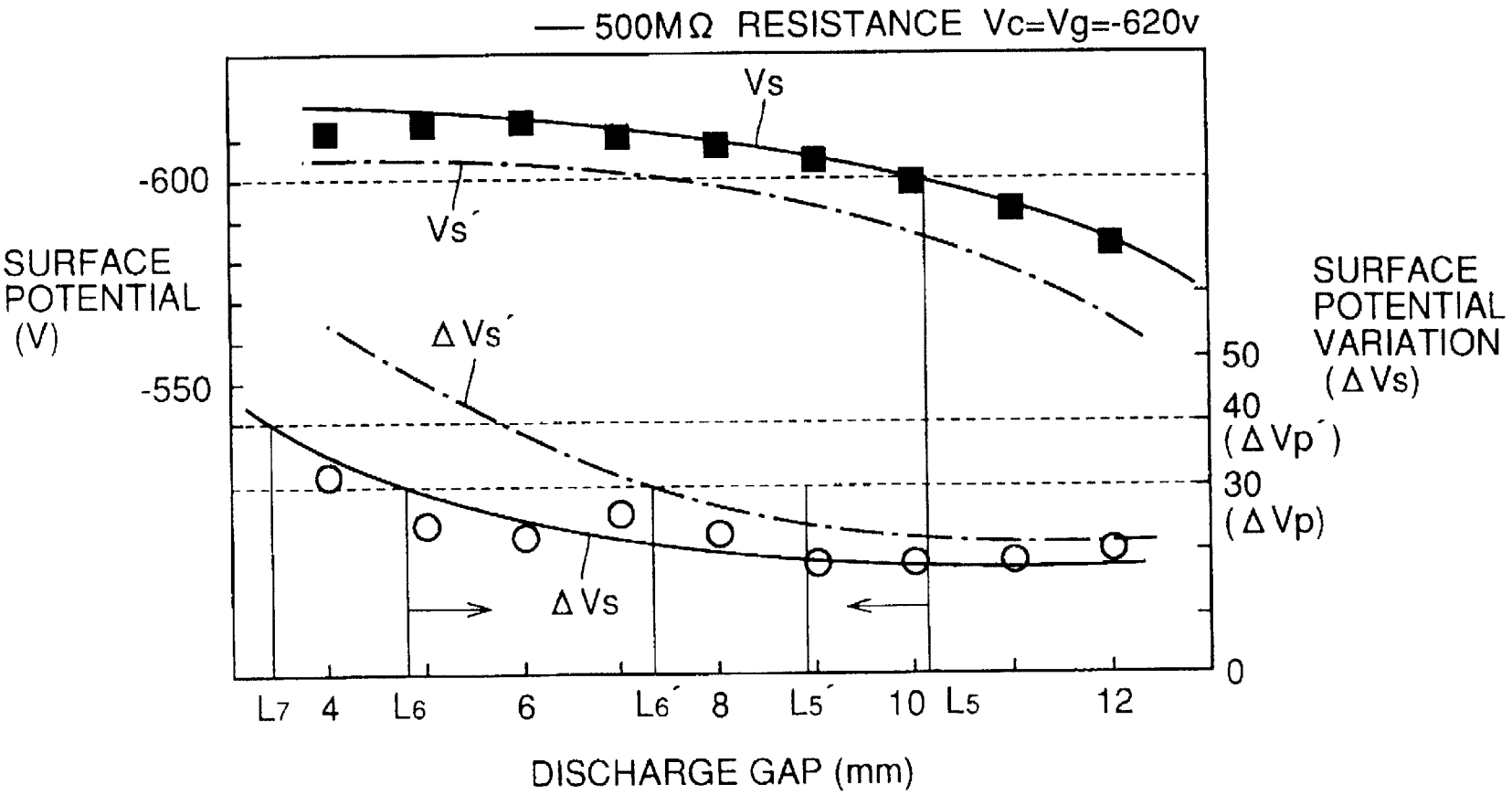
FIG. 3 shows the relationship of a discharge gap, surface potential, and applied current.

FIG. 3 shows the relationship between the discharge gap, the surface potential, and surface potential variation of this case. Discharge gap La is limited to the range of $L6 \leqq L5$.

The above fourth embodiment will be described in further detail.

Figure 7:
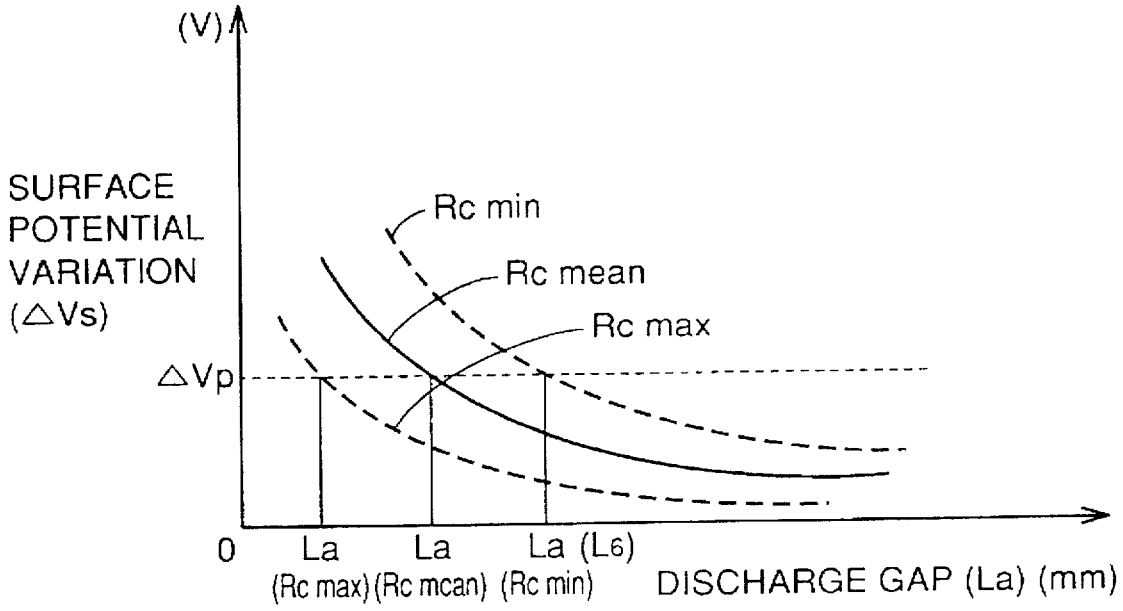
FIG. 7 shows variation in the surface potential due to a change in resistance value Rc.

FIG. 7 shows the surface potential variation with different values of resistance Rc of resistor 5. Three types of resistor values Rc are set, i.e., Rcmax, Rcmean, and Rcmin (Rcmax>Rcmean>Rcmin), and the surface potential variation for each discharge gap was obtained with the other conditions set to constant values. It is appreciated that the variation in the surface potential becomes greater as the value of Rc becomes smaller as shown in FIG. 7. Here, Rcmin where an image of favorable quality can be formed is approximately 500 MΩ. This is set forth in the following.

It is well known that increase in resistance Rc in resistor 5 causes a voltage drop due to the resistor. When the voltage drop exceeds a certain level, the discharging current in each of the plurality of discharging electrodes 3 in the charging device becomes constant. It was found that the voltage drop which is the threshold value thereof is approximately 200 V by an experiment. More specifically, a voltage drop of at least approximately 200 V allows stabilization of the discharging current, and uniform charging can be carried out on the surface of photoreceptor 12. This value of 200 V was obtained in a stable environment with no degradation, damage and adherence of foreign objects usually encountered during long-range usage. The voltage drop which becomes the threshold voltage is considered to be approximately 500 V accounting for change in the environment and the device over time in practical usage.

Here, the discharging current in the charging device is approximately 1~2 μA. It is appreciated that resistance Rcmin where the minimum voltage drop of 500 V at the minimum applied current (1 μA) is:

$$\text{voltage drop/discharging current} = 500/1.0 = 500\ (M\Omega)$$

Rcmax is approximately 2000 MΩ from the actual limit of a high voltage power supply (7~8 kV).

As described above, Rcmin is approximately 500 MΩ. The relationship of surface potential, surface potential variation, and the discharge gap with resistor 5 set to the value of 500 MΩ is shown in FIG. 3. The surface potential and the surface potential variation indicated by solid lines in FIG. 3 show the case where applied current Ip is set to approximately 2.0 μA. L6≦La≦L5 is approximately 5≦La≦10 mm. Here, the range of L6≦La≦L5 is narrowed as shown by the chain dotted line as a function of reducing applied current Ip. The range of L6'≦La≦L5' is also reduced. This is desirable from the standpoint that the applied current is reduced and that the selected range of discharge gap La is narrowed. It is further desirable that applied current Ip is approximately 1≦1.5 μA, and discharge gap La is in the range of approximately 7.5≦La≦9 mm. Thus, an image of a stable picture quality can be obtained at a low applied current.

In economical copiers and printers where the requirement of the image picture quality is not so strict, the threshold value of the surface potential variation can be reduced. For example, the threshold value of the surface potential variation is set to 30 V in the above embodiment. However, the threshold value may be set to 40 V as shown in FIG. 3. In this case, the range of discharge gap La becomes L7≦La≦L5, which is approximately 3.5~10 nm. As a result, discharge gap La can be made smaller, whereby the device can be reduced in size.

The range of the discharge gap may be limited on the basis of the combinations of the ranges obtained by the above first, third and fourth embodiments. By combining the first and third embodiments, for example, a range of discharge gap La can be limited where the required surface potential of Vo and the surface potential variation ΔVp can be achieved and where the applied power is less than the tolerable value of Ipp. Furthermore, by combining first and fourth embodiments, the range of a discharge gap La can be limited where the required surface potential Vo and the surface potential variation of ΔVp are achieved, the resistance value Rc is low, and the applied current is suppressed.

Fifth Embodiment

Discharging electrode 3 is formed of a stainless material of approximately 0.1 mm in thickness, fine-processed by etching or the like. Discharging electrode 3 is fixed on substrate 1 by means of an adhesive or the like. The assembly precision of the discharging electrodes is easily deviated due to variation in the height of the tip of the discharging electrode, the distance between the discharging electrodes, and the tilted state of the assembled discharging electrode. Offset in precision will not allow stable surface potential and surface potential variation in the range of the discharge gap set as described above. The range of discharge gap La is corrected as set forth in the following.

(1) Correction based on variation in the height of the tip of discharge electrode 3

Figures 8A, 8B:
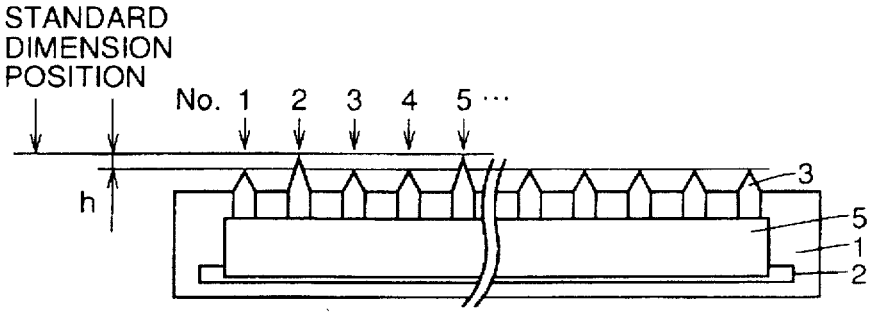
FIG. 8A is a diagram for describing a variation in the height of a discharge electrode.
FIG. 8B shows variation state in the height of a discharge electrode.

FIGS. 8A and 8B are provided to show the level of variation in the height of discharging electrode 3 with respect to the standard dimension. It is appreciated that the maximum variation in the tip height of discharging electrode 3 in FIG. 8B is 0.24 mm. It can be therefore be considered that the variation in the height of the tip of discharging electrode 3 is within −0.3 mm. Discharge gap La is corrected according to this value of −0.3 mm.

In this correction, the tip height variation of −0.3 mm is used to reduce discharge gap La. This is because the direction of the height of discharging electrode 3 coincides with the direction of the length of discharge gap La. The examples of the discharge gap shown in the fourth embodiment, for example, are corrected as follows:

General discharp gap: 5~10 mm→5.3~9.7 mm

Discharge gap at favorable state: 7.5~9 mm→7.8~8.7 mm

Discharge gap for small device: 3.5~10 mm→3.8~9.7 mm

By the above correction, stable surface potential and surface potential variation can be obtained even when there is difference in the height of a tip of discharging electrode 3.

(2) Correction based on variation in distance between each discharging electrode 3

Figures 9A, 9B:
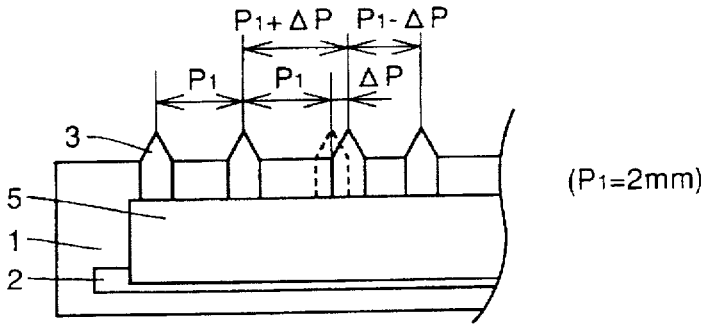
FIG. 9A is a diagram for describing variation in the distance between discharge electrodes.
FIG. 9B shows variation state in the distance of discharge electrodes.

FIGS. 9A and 9B are provided to show the level of a variation in the distance between respective discharge electrodes 3 with respect to the standard dimension. It is appreciated that the maximum and minimum values of distance P in FIG. 9B is +0.162 mm and −0.148 mm, respectively. This means that there is a maximum difference of 0.310 mm, i.e., approximately 0.3 mm. Therefore, discharge gap La is corrected according to this level of variation of 0.3 mm.

Figure 10:
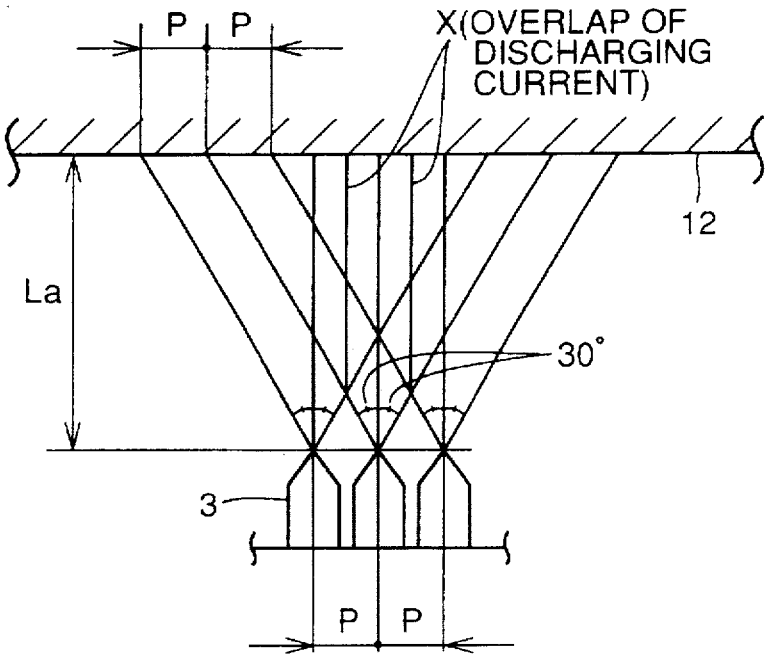
FIG. 10 is a diagram for describing the method of converting variation in the distance of discharge electrodes into a value of a discharge gap.

The method of correction according to conversion of the variation of distance P between discharge electrodes 3 into discharge gap La will be described hereinafter with reference to FIG. 10. The discharging current from each discharging electrode 3 overlie each other on the surface of photoreceptor 12 to effect charging thereof. It is therefore considered that the surface potential of photoreceptor 12 is influenced by the overlapping state of the discharging current generated due to variation in the distance between discharging electrodes 3. When the configuration of a discharging electrode 3 is designed so that the spread of a discharging current from discharging electrodes 3 is at the angle of approximately 30°, the amount of correction of discharge gap La when the distance P between discharge electrodes 3 is offset by 0.3 mm can be obtained as set forth in the following.

$$\chi = La - \frac{\sqrt{3}}{p}\,p$$

Here, when La=9, and P=2, $$\chi = La - \frac{\sqrt{3}}{2}\,p = 9 - \frac{\sqrt{3}}{2} \times 2 \approx 7.27$$

When P is offset by 0.3 mm, the amount of difference Δχ of χ becomes:

$$\begin{aligned} \Delta\chi P &= 7.27 - \left(9 - \frac{\sqrt{3}}{2} \times 2.3\right) \\ &= 7.27 - (\approx 7.01) \\ &\approx 0.26 \end{aligned}$$

When La is offset by 0.3 mm, the amount of difference ΔχLa of χ becomes:

$$\begin{aligned} \Delta\chi La &= 7.27 - \left(9.3 - \frac{\sqrt{3}}{2} \times 2\right) \\ &= 7.27 - (\approx 7.57) \\ &\approx 0.3 \end{aligned}$$

From the foregoing, it can be considered that:

$$|\Delta\chi P| \approx |\Delta\chi La|$$

It is therefore appreciated that the offset of P can be replaced with the amount of offset in La.

In order to correct the offset of this distance P between discharging electrodes 3, the length of discharge gap La should be moved by the amount of the offset of distance P of discharging electrode 3, i.e. 0.3 mm. More specifically, the examples of the discharge gap shown in the fourth embodiment are corrected as follows:

General discharge gap: 5~10 mm→5.3~9.7 mm

Discharge gap at favorable state: 7.5~9 mm→7.8~8.7 mm

Discharge gap for small device: 3.5~10 mm→3.8~9.7 mm

According to the above correction, stable surface potential and surface variation can be obtained even when there is variation in the distance P between discharging electrodes 3.

(3) Correction based on the tilt of an attached discharging electrode 3

Figure 11:
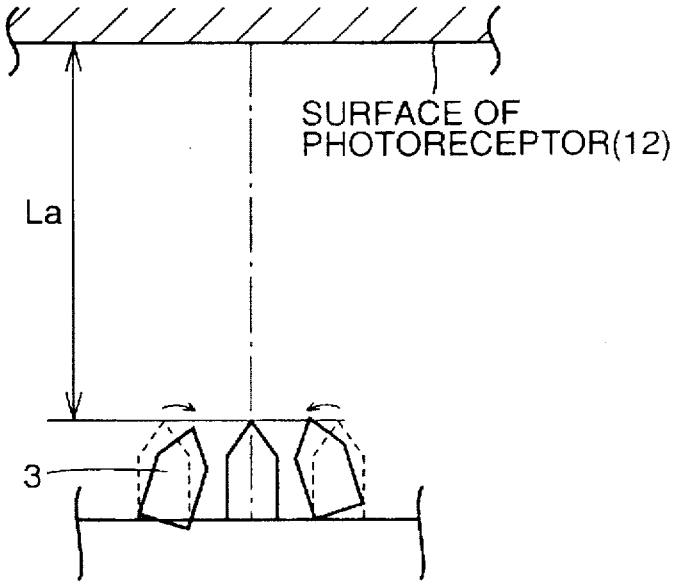
FIG. 11 shows the tilting states of discharge electrodes.

When discharging electrode 3 is attached in a tilted manner as shown in FIG. 11, correction of discharge gap La is carried out as set forth in the following. It is considered that a discharging electrode 3 attached in a tilting manner has the factors of variation in the height of the tip of discharging electrode 3 and variation in the distance between adjacent discharging electrodes 3 overlapping at the rate of ½ respectively. Therefore, correction is carried out by assuming that the length in the tilted manner is the variation in the height of discharging electrode 3. For example, when the length of the tilt is 0.3 mm, discharge gap La is reduced by the exact 0.3 mm. Specifically, the examples of the discharge gaps shown in the fourth embodiments are corrected as follows:

General discharge gap: 5~10 mm→5.3~9.7 mm

Discharge gap at favorable state: 7.5~9 mm→7.8→8.7 mm

Discharge gap for small device: 3.5~10 mm~3.8~9.7 mm

According to the above correction, stable surface potential and surface potential variation can be obtained even when discharging electrode 3 is attached in a tilted manner.

(4) Correction based on the entire assembled precision of discharging electrode 3

As described above, there is some error in the assembly manufacturing process of a discharging electrode. All the error is assumed to be accumulated to the sum of approximately 1 mm, which is a value calculated corresponding to the value of discharge gap La. The distance of discharge gap La is corrected according to this overall assembly precision. For example, the discharge gap examples shown in the fourth embodiment are corrected as follows:

General discharge gap: 5~10 mm→6~9 mm

Discharge gap at favorable state: 7.5~9 mm→8.5~8 mm

Discharge gap for small device: 3.5~10 mm→4.5~9 mm

According to the above correction, stable surface potential and surface potential variation can be obtained even where there is offset in the assembly precision of discharging electrode 3.

As described above, the set range of discharge gap La is corrected according to the assembly precision of discharging electrode 3. The assembly precision of discharge electrode 3, for example, variation in the height of the tip of discharging electrode 3, the distance between discharging electrodes 3 and the tilted state of discharging electrode 3 affect the surface potential and the surface potential variation. Variation exceeding a certain level will result in increase/decrease of the surface potential or a greater surface potential variation. Therefore, the range of discharge gap La is corrected according to the assembly precision of discharging electrode 3 to absorb the influence of the assembly precision of discharging electrode 3.

Sixth Embodiment (1) Correction based on change in resistance over time

Resistor 5 is formed by mixing a conductor such as of carbon into a resin material. If distribution of carbon is not uniform, energization of resistor 5 cause structural change in the resin, whereby resistance value Rc is easily increased. Furthermore, heat generated by the energization causes thermal expansion in resistor 5, whereby resistance value Rc increases. In other words, resistance value Rc of resistor 5 is apt to increase over time. In a device employing a plurality of resistors 5, the variation of each resistor will increase over time. Increase in the variation of resistance value of resistor 5 causes a greater surface potential variation on the photoreceptor.

FIG. 12 shows the change in the actual resistance over time. The results of the resistance and the value variation of the plurality of resistors are indicated where a copy operation is carried out by a copier at the speed of 1000 sheets/hour. It is appreciated from FIG. 12 that the resistance increases over time, and variation thereof becomes greater (disapprovable) over time.

The impedance of the gap between discharging electrode 3 and photoreceptor 12 was at least ±40%. Therefore, sufficient effect of resistor 5 can be obtained when the variation of resistance value Rc of resistor 5 is within this value of ±40%, preferably within ±30%.

Figure 13:
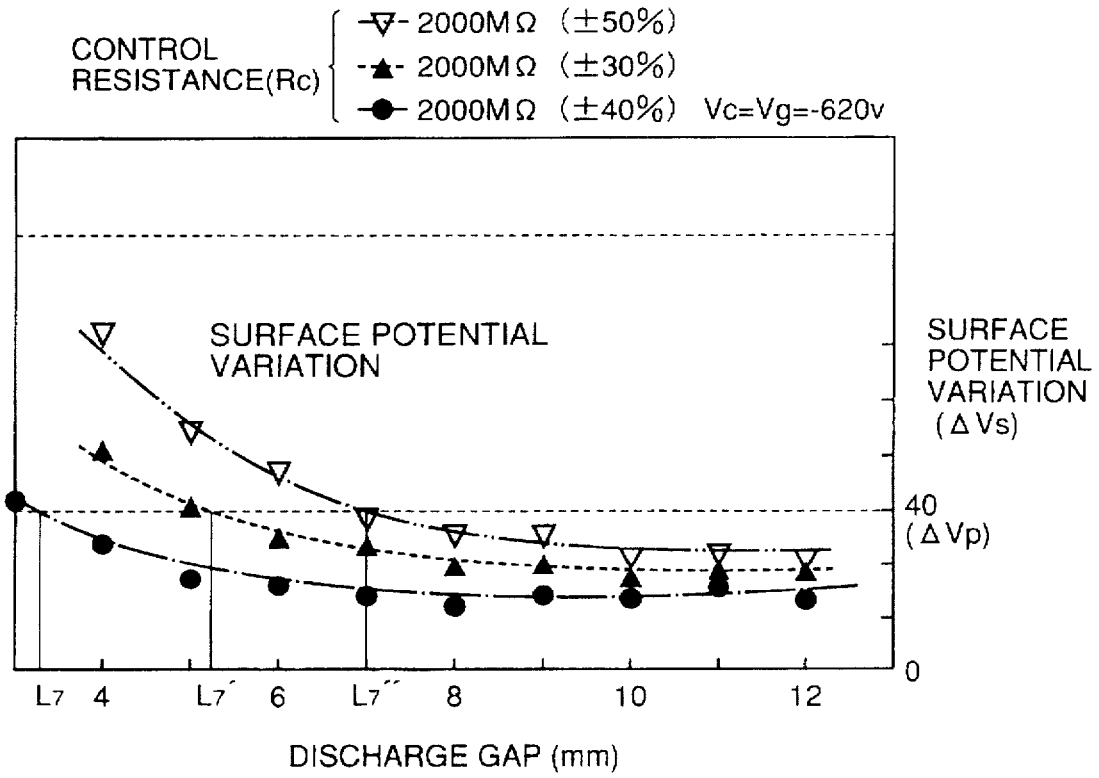
FIG. 13 shows the change in the lower limit value of the discharge gap when variation in resistance is altered over time.

Here, the effect of variation in resistance value Rc of resistor 5 on the surface potential variation of the photoreceptor was evaluated. FIG. 13 shows the surface potential variation characteristics where the variation of resistance value Rc of resistor 5 is set to ±30%, ±40%, and ±50%. This figure is provided to indicate change in the level of the surface potential variation, and the resistance value of resistor 5 is set to an extremely high value (2000 MΩ) to prevent excessive increase of the level of the surface potential variation. It is appreciated from FIG. 13 that the change in the variation of resistance value Rc to ±30%, ±40%, and ±50% causes a shift of approximately 2 mm for respective discharge gaps L7, L7', L7" to obtain a favorable surface potential variation (within 40 V). It is therefore appreciated that the lower limit value of discharge gap La must be corrected by approximately 2 mm in a copier where a copy operation of approximately 30000 sheets (life of 30000 copies) is carried out. For example, the discharge gaps of the fourth embodiment are corrected as follows:

Dischargegapofgeneraldevice: 5~10 mm→7~10 mm

Discharge gap for small device: 3.5~10 mm→5.5~10 mm

According to the above correction, stable surface potential and surface potential variation can be obtained even when the resistance value changes over time.

(2) Correction based on change in resistance by temperature

Figure 15:
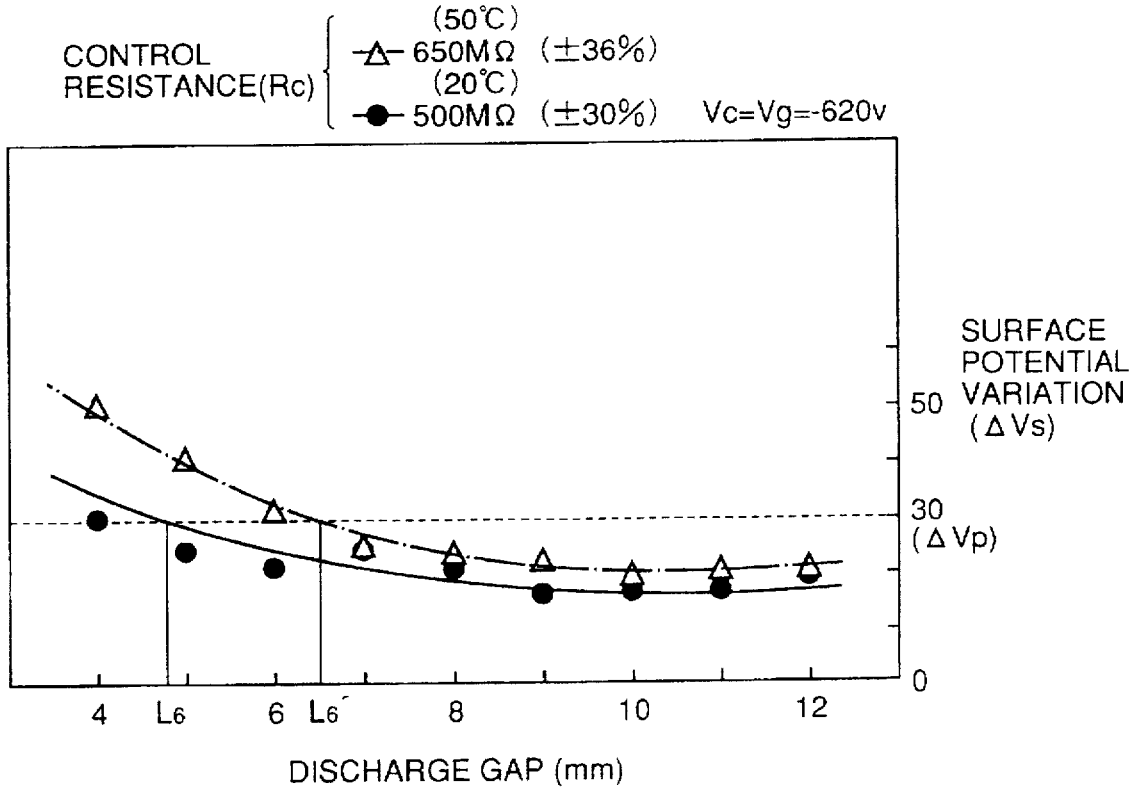
FIG. 15 shows a change in the lower limit value of the discharge gap when the resistance variation is altered due to temperature.

Resistance value Rc of resistor 5 is influenced by the environment temperature to result in change in resistance value Rc and resistance value variation. It is appreciated from FIG. 14 that an increase in the environment temperature causes increase in both the resistance value Rc and resistance value variation. The change in discharge gap La at the temperature of 50° C. with respect to the normal environment temperature of 20° C. is to be obtained. Referring to FIG. 15, the surface potential variation when Rc is 500 MΩ and Rc variation is ±30% at an environment of 20° C. and when Rc is 650 MΩ and Rc variation is ±36% at an environment of 50° C. are obtained. Then, discharge gaps L6 and L6' are found where a surface potential variation within the tolerable range (300 V) is obtained. It is appreciated from FIG. 15 that discharge gap La is increased by approximately 1.5 mm in an environment of 50° C. with respect to the general state. Therefore, the lower limit value of the discharge gap must be corrected by approximately 1.5 mm in order to allow for change in the temperature. For example, the discharge gaps of the fourth embodiment are corrected as follows:

General discharge gap: 5~10 mm→6.5~10 mm

Discharge gap at favorable state: 7.5~9 mm→approximately 9 mm

Discharge gap for small device: 3.5~10 mm→5~10 mm

According to the above correction, a stable surface potential and surface potential variation can be obtained even when the resistance changes in response to the temperature.

(3) Correction based on changing resistance due to humidity

Figure 17:
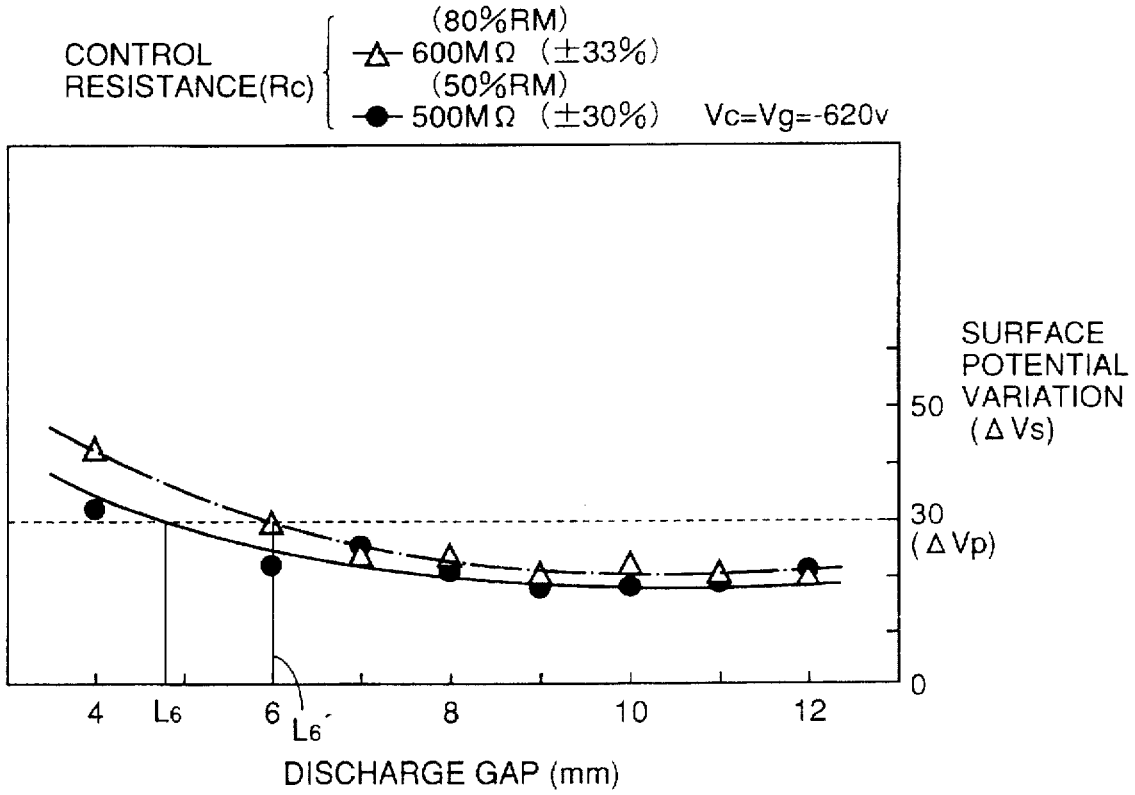
FIG. 17 shows a change in the lower limit value of the discharge gap when the resistance value variation is altered by humidity.

Resistance value Rc of resistor 5 is affected by humidity to result in change in resistance value RC and resistance value variation. It is appreciated from FIG. 6 that increase in humidity causes increase in the resistance value Rc and the resistance value variation. Here, change of discharge gap La at the humidity of 80% with respect to the normal humidity 50% is to be obtained. Referring to FIG. 17 the surface potential variation when Rc is 500 MΩ and Rc variation is ±30% in an environment at 50% and when Rc is 600 MΩ and RC variation is ±33% in an environment of 80% are obtained. Then, discharge gap La is found where a surface potential variation within the tolerable range (30 V) is obtained. It is appreciated from FIG. 17 that discharge gap La is increased by approximately 1 mm in an environment of 80% with respect to the general state. Therefore, the lower limit value of discharge gap La must be corrected by approximately 1 mm to allow for change in the humidity. For example, the examples of the discharge gap of the fourth environment are corrected as follows:

General discharge gap: 5~10 mm→6~10 mm

Discharge gap at favorable state: 7.5~9 mm→8.5~9 mm

Discharge gap for small device: 3.5~10 mm→4.5~10 mm

According to the above correction, stable surface potential and surface potential variation can be obtained even when the resistance changes over time.

(4) Correction based on change in resistance of resistor

As described above, resistor 5 is affected by the temperature and humidity of the environment. The corrected amount of the value of discharge gap La combining all these influences is approximately 2+1.5+1=4.5 mm. Correction of the range of discharge gap La based on change in the resistance of the resisters are as follows according to the discharge gap of the fourth embodiment.

General discharge gap: 5~10 mm→9.5~10 mm

Discharge gap for small device: 3.5~10 mm→8~10 mm

According to the above correction, a stable surface potential and surface potential generation can be obtained even when the resistance of the resistor changes.

As described above, the range of discharge gap La is corrected according to change in the resistance of a resistor inserted between a power supply device and a discharging electrode. Change in the resistance, for example, by elapse of time or by change in temperature or humidity affects the surface potential and the surface potential variation particularly. A greater variation causes increase/decrease of the surface potential and increase of the surface potential variation. Therefore, the range of discharge gap La is corrected according to the change in the resistance to absorb the influence of resistance change. Therefore, stable surface potential and surface potential variation can be obtained even when the resistance of the resistor is altered due to influence of time, temperature, and humidity.

Seventh Embodiment

Figure 18:
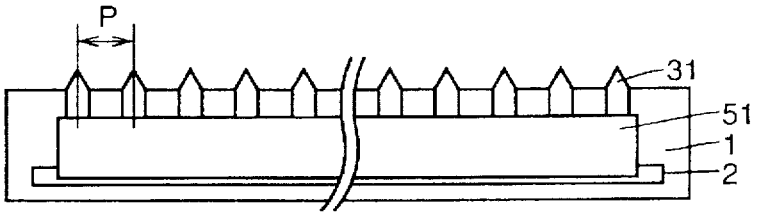
FIG. 18 shows a structure of the discharging electrode portion and the resistor portion.

FIG. 18 shows a structure of a discharging electrode portion according to a seventh embodiment of the present invention. The structure of insulative substrate 1 and common electrode 2 is similar to that shown in FIG. 19, provided that a resistor 51 formed of a thin sheet is provided in common electrode 2. Resistor 51 is a sheet member having a thickness of approximately 0.05~0.5 mm. Resistor 5 is formed of a material having an additive mixed such as an inorganic material of carbon black, metallic powder or the like forming an economical resistor, a metal oxide of zinc oxide, ruthenium oxide, or the like forming a high resistor, and alkali metal salt indicting ion conductivity of halogen oxyacid, per halogen oxyacid, lithium perchlorate, or the like forming an uniform resistor with low local resistance variation into a base of an organic material such as polyethylene, polyester, polyurethane, nylon, polyamide, polyimide, polycarbonate, or the like. By mixing these additives, the resistance value Rc of resistor 31 is approximately 500 MΩ and the variation thereof is within ±30%. Discharging electrodes 31 at a predetermined pitch of P (approximately 2 mm) are connected to resistor 51.

By forming resistor 51 of a thin sheet common to all the discharging electrodes, error in the arrangement of the resistor position is eliminated to provide the advantages that the distance between each discharging electrode 31 and common electrode 2 is constant, the electrode portion is reduced in size due to the thin sheet configuration, the manufacturing process is simplified due to the alleviation of the critical attachment of the resistor.

In the above-described embodiments, the discharging electrode is controlled to provide constant current. It is preferable that the supply power supplied towards discharging electrodes 3, 31 is controlled to provide constant current in the circumstances where the environment condition, particularly, the humidity is general. It is to be noted that in an environment where the humidity is high, the gap impedance between the photoreceptor and the discharging electrgap) discharge gap) is reduced to result in increase of leakage current. This means that the current flowing to the surface of the photoreceptor will be reduced in the above described constant control. Therefore, constant voltage control is preferable in an environment of high humidity to compensate for the generation of leakage current caused by reduction in the gap impedance. Therefore, the current towards the surface of the photoreceptor can be stabilized.

Thus, a device manufactured with respect to an environment of high humidity is formed to have a structure where constant voltage control is provided. Accordingly, degradation in the picture quality due to influence of humidity can be suppressed. Alternatively, a structure can be provided including a constant current control circuit for supplying constant current to a discharging electrode, a constant voltage control circuit for providing a constant voltage to a discharging electrode, a selection circuit for selecting either of these circuits, and a sensor for detecting humidity within the device, wherein the constant current control circuit is selected by the selection circuit when a low humidity state is detected by the humidity detection sensor, and the constant voltage current circuit is selected by the selection circuit when a high humidity state is detected by the humidity detection sensor. As a result, the surface of the photoreceptor can be charged at a stable potential irrespective of the environment in which the device is placed. Therefore, there is no degradation in the quality of the image.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A charging device comprising:

a body to be charged, a discharging electrode arranged facing said body to be charged, a power supply device for constant-current-controlling said discharging electrode, and a resistor inserted between said discharging electrode and said power supply device, wherein a discharge gap La between said body to be charged and said discharging electrode satisfies a relation of:

$$L2 \leqq La \leqq L1$$

where L1 is an upper limit value of a discharge gap where a surface potential of at least a predetermined surface potential Vo is obtained, and L2, which has a value less than L1, is a lower limit value of a discharge gap where a surface potential variation not more than a predetermined tolerable surface potential variation $\Delta Vp$ is obtained.

2. The charging device according to claim 1, wherein said discharging electrode are precisionally assembled so that discharge gap La is further corrected.

3. The charging device according to claim 1, wherein said discharging electrode comprises a plurality of discharging electrodes, a range of said discharge gap La is corrected on the basis of at least one of variation in the height of a tip of said plurality of discharging electrodes, variation in distance between said plurality of discharging electrodes, and variation in the tilt of said plurality of discharging electrodes.

4. The charging device according to claim 1, wherein a range of said discharge gap La is further corrected based on the value of the resistance of said resistor.

5. The charging device according to claim 1, wherein a range of said discharge gap La is further corrected on the basis of at least one of change in resistance of said resistor by elapse of time, temperature, or humidity.

6. The charging device according to claim 1, wherein said discharging electrode comprises a plurality of discharging electrodes, said resistor comprises one thin sheet common to said plurality of discharging electrodes.

7. The charging device according to claim 1, wherein La is in a range of approximately 3.5~10 mm.

8. The charging device according to claim 7, wherein a required surface potential is (−600V) and the tolerable surface potential variation is (30V).

9. The charging device according to claim 7 wherein La is approximately 7.5 mm.

10. A charging device comprising:

a body to be charged, a discharging electrode arranged facing said body to be charged, a power supply device for constant-current-controlling said discharging electrode, a resistor inserted between said discharging electrode and said power supply device, wherein a current applied from said power supply device to said discharging electrode is set so that an upper limit value of a discharge gap where a surface potential of at least a predetermined surface potential of Vo is obtained is substantially equal to a lower limit value of a discharge gap where a surface potential variation is obtained of not more than a predetermined tolerable surface potential variation of $\Delta Vp$, wherein a discharge gap between said body to be charged and said discharging electrode is set so that so that said upper limit value and said lower limit value are substantially equal.

11. A charging device comprising:

a body to be charged, a discharging electrode arranged facing said body to be charged, a power supply device for constant-current-controlling said discharging electrode, and a resistor inserted between said discharging electrode and said power supply device, wherein a discharge gap La between said body to be charged and said discharging electrode satisfies a relation of:

$$L3 \leqq La \leqq L1$$

where L1 is an upper limit value of a discharge gap where a surface potential of at least a predetermined surface potential of Vo is obtained, and L3, which is less than L1, is a discharge gap where a surface potential variation of not more than a predetermined tolerable surface potential variation of $\Delta Vp$ is obtained, and when an applied current at the presence of said resistor is substantially equal to an applied current at the absence of said resistor.

12. A charging device comprising:

a body to be charged, a discharging electrode arranged facing said body to be charged, a power supply device for constant-current-controlling said discharging electrode, and a resistor inserted between said discharging electrode and said power supply device, wherein a resistance value of said resistor is set to a minimum resistance value of Rcmin where a minimum voltage drop required for absorbing surface potential variation is provided, wherein a discharge gap La between said body to be charged and said discharging electrode satisfies a relation of:

$$L6 \leqq La \leqq L5$$

where L5 is an upper limit value of a discharge gap where a surface potential of at least a predetermined surface potential Vo is obtained when the resistance value of said resistor is set to said minimum resistance value Rcmin, and L6, which is less than L5, is a lower limit value of a discharge gap where a surface potential variation not more than a predetermined tolerable surface potential variation of ΔVp is obtained when the resistance value of said resistor is set to minimum resistance value Rcmin.

13. In a charging device including a body to be charged, a discharge electrode arranged corresponding to said body to be charged, a power supply device for constant-current-controlling said discharging electrode, and a resistor inserted between said discharging electrode and said power supply device, a discharge gap setting method of setting a discharge gap La between said body to be charged and said charging electrode, said method comprising the steps of:

(a) finding an upper limit value L1 of a discharge gap where a surface potential of at least a predetermined surface potential Vo is obtained, (b) finding a lower limit value L2 of a discharge gap where a surface potential variation of not more than a predetermined tolerable surface potential variation ΔVp is obtained, and (c) setting said discharge gap La so that said discharge gap La satisfies a relation of:

$$L2 \leq La \leq L1,$$

wherein L2 is less than L1.

14. The discharge gap setting method according to claim 13, further comprising (d) correcting a range of said discharge gap La on the basis of an assemble precision of said discharge electrode.

15. The discharge gap setting method according to claim 13, said discharging electrode comprising a plurality of discharging electrodes, wherein said discharge gap setting method further comprises (d) correcting a range of said discharge gap La on the basis of at least one of variation in the height of the tip of said plurality of discharging electrodes, variation in the distance between said plurality of discharging electrodes, and variation in the tilt of said plurality of discharging electrodes.

16. The discharge gap setting method according to claim 13, further comprising (d) correcting a range of said discharge gap La according to a change in resistance and said resistor.

17. The discharge gap setting method according to claim 13, further comprising (d) correcting a range of said discharge gap La according to at least one of a change in resistance of said resistor according to elapse of time, temperature and humidity.

18. In a charging device including a body to be charged, a discharging electrode arranged corresponding to said body to be charged, a power supply device for constant-current-controlling said discharging electrode, and a resistor inserted between said discharging electrode and said power supply device, a discharge gap setting method of setting a discharge gap La between said body to be charged and said discharge electrode, said method comprising the steps of:

(a) setting a current applied from said power supply device to said discharging electrode so that an upper limit value of a discharge gap where a surface potential of at least a predetermined surface potential Vo is obtained is substantially equal to a lower limit value of a discharge gap where a surface potential variation of not more than a predetermined tolerable surface potential variation ΔVp is obtained, and (b) setting said discharge gap La so that said upper limit value and said lower limit value are substantially equal.

19. In a charging device including a body to be charged, a discharging electrode arranged corresponding to said body to be charged, a power supply device for constant-current-controlling said discharge electrode, and a resistor inserted between said discharging electrode and said power supply device, a discharge gap setting method of setting a discharge gap La between said body to be charged and said discharging electrode, said method comprising the steps of:

(a) finding an upper limit value L1 of a discharge gap where a surface potential of at least a predetermined surface potential Vo is obtained, (b) finding a discharge gap L3 where a surface potential variation of not more than a predetermined tolerable surface potential variation ΔVp is obtained, and when an applied current at the presence of said resistor is substantially equal to an applied current at the absence of said resistor, and (c) setting said discharge gap La so that said discharge gap La satisfies a relation of:

$$L3 \leq La \leq L1,$$

wherein L3 is less than L1.

20. A charging device including a body to be charged, a discharging electrode arranged corresponding to said body to be charged, a power supply device for constant-current-controlling said discharging electrode, and a resistor inserted between said discharging electrode and said power supply device, a discharge gap setting method of setting a discharge gap La between said body to be charged and said discharging electrode, said method comprising:

(a) setting a resistance of said resistor to a minimum resistance value Rcmin where a minimum voltage drop required for absorbing surface potential variation is provided, (b) finding an upper limit value L5 of a discharge gap where a surface potential of at least a predetermined surface potential Vo is obtained when the resistance of said resistor is set to said minimum resistance value Rcmin, (c) finding a lower limit value L6 of a discharge gap where a surface potential variation of not more than a predetermined tolerable surface variation ΔVp is obtained when the resistance of said resistor is set to said minimum resistance value Rcmin, and (d) setting said discharge gap La so that discharge gap La satisfies a relationship of:

$$L6 \leq La \leq L5,$$

wherein L6 is less than L5.

* * * * *